US011785391B2

(12) United States Patent
Liechti et al.

(10) Patent No.: US 11,785,391 B2
(45) Date of Patent: Oct. 10, 2023

(54) MICROMETRIC LOUDSPEAKER

(71) Applicants: COMMISSARIAT A L'ENERGIE ATOMIQUE ET AUX ENERGIES ALTERNATIVES, Paris (FR); CENTRE NATIONAL DE LA RECHERCHE SCIENTIFIQUE, Paris (FR); UNIVERSITE DU MANS, Le Mans (FR)

(72) Inventors: Romain Liechti, Grenoble (FR); Fabrice Casset, Grenoble (FR); Thierry Hilt, Grenoble (FR); Stephane Durand, Pruille le Chetif (FR)

(73) Assignees: COMMISSARIAT A L'ENERGIE ATOMIQUE ET AUX ENERGIES ALTERNATIVES, Paris (FR); CENTRE NATIONAL DE LA RECHERCHE SCIENTIFIQUE, Paris (FR); UNIVERSITE DU MANS, Le Mans (FR)

( * ) Notice: Subject to any disclaimer, the term of this patent is extended or adjusted under 35 U.S.C. 154(b) by 0 days.

(21) Appl. No.: 17/721,950

(22) Filed: Apr. 15, 2022

(65) Prior Publication Data

US 2022/0337954 A1 Oct. 20, 2022

(30) Foreign Application Priority Data

Apr. 15, 2021 (FR) ..... 21 03908

(51) Int. Cl.
*H04R 7/24* (2006.01)
*H04R 7/02* (2006.01)
(Continued)

(52) U.S. Cl.
CPC ..... *H04R 7/24* (2013.01); *H04R 1/288* (2013.01); *H04R 7/02* (2013.01); *H04R 17/00* (2013.01);
(Continued)

(58) Field of Classification Search
None
See application file for complete search history.

(56) References Cited

U.S. PATENT DOCUMENTS

| | | | | |
|---|---|---|---|---|
| 9,980,051 | B2 | 5/2018 | Clerici et al. | |
| 2012/0057730 | A1 | 3/2012 | Fujise et al. | |
| 2014/0029773 | A1* | 1/2014 | Kano | H04R 17/00 381/190 |

FOREIGN PATENT DOCUMENTS

| | | | |
|---|---|---|---|
| CN | 111918179 | A | 11/2020 |
| EP | 3 670 439 | A1 | 6/2020 |

OTHER PUBLICATIONS

French Preliminary Search Report dated Dec. 23, 2021 in French Application 21 03908 filed on Apr. 15, 2021, 11 pages (with English Translation of Categories of Cited Documents & Written Opinion).
(Continued)

*Primary Examiner* — Mark Fischer
(74) *Attorney, Agent, or Firm* — Oblon, McClelland, Maier & Neustadt, L.L.P.

(57) ABSTRACT

A micrometric speaker includes a frame, an electromechanical transducer, and a mechanical-acoustic transducer comprising a rigid plate movably mounted in the frame. The electromechanical transducer comprises two piezoelectric actuators and two elastic strips. The frame comprises a central crossmember from which the two strips extend until engaging two lateral coupling edges of the mechanical-acoustic transducer, and the mechanical-acoustic transducer comprises two linearising springs each extending from one of the lateral edges to the rigid plate, to enable, during a
(Continued)

deformation of the strips, a movement of the two lateral edges to the central crossmember and reduce the longitudinal constraints applied to the strips during their deformation due to their "recessed-guided" bending configuration.

20 Claims, 8 Drawing Sheets

(51) Int. Cl.
*H04R 17/00* (2006.01)
*H04R 1/28* (2006.01)

(52) U.S. Cl.
CPC .... *H04R 2207/021* (2013.01); *H04R 2400/11* (2013.01); *H04R 2499/11* (2013.01)

(56) References Cited

OTHER PUBLICATIONS

Sturtzer et al., "High Fidelity MEMS Electrodynamic Micro-Speaker Characterization", Journal of Applied Physics 113, 214905, 2013, 29 pages.
Stoppel et al., "Novel type of MEMS loudspeaker featuring membraneless two-way sound generation ", AES E-Library, Convention Paper 9874, 2017, 6 pages.

* cited by examiner

MICROMETRIC LOUDSPEAKER

TECHNICAL FIELD

The present invention relates to the field of micrometric speakers. It has a particularly advantageous application in the integration of at least one speaker in computers, mobile phones and other earpieces, in particular, wireless.

STATE OF THE ART

The speaker is used to transform an electric signal into acoustic pressure.

For numerous years, speakers have been made smaller to be integrated, in particular in computers, mobile phones, smart speakers and other earpieces, for example, wireless.

The speaker is an electromechanical-acoustic transducer. In its linear principle, the operation of the speaker passes through the actuation of a membrane or a rigid plate, couple with ambient air.

The electric signal passes through the electromechanical transducer which converts the supply voltage from the speaker into movements. A mechanical-acoustic transducer, is very often a membrane, converts this movement into acoustic pressure.

A good speaker is a speaker reproducing all the sound frequencies which are perceptible (typically, from 20 Hz to 20 kHz) at the same amplitude, with a low distortion rate. In practice, the lowest frequency at which a speaker effectively produces sound is determined by the resonating frequency of the mechanical-acoustic transducer.

In the context of making smaller, the system for guiding the membrane is more rigid and the mass of the mechanical-acoustic transducer is lower, which increases the resonating frequency of the system and therefore reduces the bandwidth.

Furthermore, the acoustic pressure level radiated by a speaker depends on the volume of air accelerated by the mechanical-acoustic transducer. The volume of air accelerated by a speaker depends on the product of the surface of the mechanical-acoustic transducer and on the maximum movement of the mechanical-acoustic transducer.

In the context of making smaller, the surface of the mechanical-acoustic transducer is greatly reduced, and a significant movement is necessary to obtain a satisfactory acoustic pressure level. Micrometric speakers (also called "MEMS speakers" or micro-speakers) are mainly based on the utilisation of compliance of flexible membranes. However, these are rigidified under the effect of their deformations, which explains that flexible membrane micrometric speakers suffer from increased geometric non-linearities.

Flexible membrane micrometric speakers equipping mobile phones show dimensions, typically of 11×15×3 $mm^3$, advantageous for their integration, and make it possible to generate a satisfactory radiated pressure, typically of 85 dB, over a wide range of frequencies relative to the extent of the range of perceptible sound frequencies. Nevertheless, the bulk of this speaker type is less and less compatible with the thickness of mobile devices which does not stop reducing.

Moreover, to achieve large movements and to obtain a satisfactory acoustic pressure level, the electromagnetic transduction, to convert the supply voltage from the speaker into movement of its membrane or of its rigid plate, remains a solution of choice, and it is that which equips the large majority of current speakers. However, the dimensions of this speaker type do not make it possible for an integration in mobile systems and to resort to a magnet makes it incompatible with micromanufacturing methods.

Another means of converting supply voltage from the speaker into movement of its membrane (or of its rigid plate), which shows notable performances, is piezoelectric transduction. Although not necessarily conferring large movements to the membrane or to the rigid plate, piezoelectric transduction has the advantage of being compatible with micromanufacturing methods. More specifically, by using the bimetal effect of a piezoelectric transducer positioned on the membrane to be moved, like for example in patent document US 2012/057730 A1, performances comparable to those of electromagnetic transducers are achievable. In other cases, like for example in the MEMS speaker described by patent applications referenced US 20170094418 A1 and CN 111 918 179 A, the piezoelectric transducers are moved from the membrane, and this solution enables a piston movement of it. This latter solution, with moved actuators, enables to avoid problems of the preceding solution. This advantageous solution further requires a lesser silicon surface and the footprint of the speaker can thus be advantageously reduced. Despite these advantages, this solution does not enable large movements, and the bandwidth that such MEMS speakers enable to reach remains reduced. In addition, by enlarging the speaker to obtain a lower resonating frequency, and therefore a wider bandwidth, piezoelectric actuators tend to adopt non-linear behaviours which are directly reverberated, negatively, on the performances of the speaker. Also, when the speaker is constituted of a "MEMS motor" and a membrane, for example made of polymer, assembled heterogeneously, non-linearities linked to the deformation of the polymer membrane appear, which affect there again, negatively, the performances of the speaker.

An aim of the present invention is therefore to propose a micrometric speaker which makes it possible to overcome at least one of the disadvantages of the state of the art.

An aim of the present invention is more particularly to propose a micrometric speaker which has satisfactory performances, in particular in terms of bandwidth and/or pressure level produced and/or which has improved performances, in particular by avoiding piezoelectric actuators adopting non-linear behaviours. Other aims, characteristics and advantages of the present invention will appear upon examining the following description and accompanying drawings. It is understood that other advantages can be incorporated.

SUMMARY

To achieve this aim, according to an embodiment, a micrometric speaker is provided, comprising:

A frame,

An electromechanical transducer, and

A mechanical-acoustic transducer comprising a rigid plate, movably mounted in the frame, the electromechanical transducer and the mechanical-acoustic transducer being coupled together such that an urging of the electromechanical transducer moves the mechanical-acoustic transducer relative to the frame and that a corresponding movement of the mechanical-acoustic transducer is converted into acoustic pressure.

The micrometric speaker is mainly such that the electromechanical transducer comprises two piezoelectric actuators and two elastic strips, each piezoelectric actuator being associated with an elastic strip to induce, when it is electrically powered, a deformation of the elastic strip by bimetal effect, the frame comprises a central crossmember from which extend, securely and opposite one another, the two elastic strips, the two elastic strips extend from the central crossmember of the frame until engaging two so-called coupling lateral edges of the mechanical-acoustic transducer.

In this way, each elastic strip is in a so-called "recessed-guided" bending configuration, according to which, when the piezoelectric actuators are electrically powered, the elastic strips are deformed and drive with them, a movement of the rigid plate of the mechanical-acoustic transducer according to a direction substantially perpendicular to a main extension plane of the frame.

The mechanical-acoustic transducer further comprises at least two linearising springs each extending from one of the lateral coupling edges to a lateral edge of the rigid plate, which is located opposite, the linearising springs being configured so as to enable, during a deformation of the elastic strips, a movement of at least some of the two lateral coupling edges to the central crossmember of the frame.

Thus, the longitudinal constraints undergone by the elastic strips during their deformation are reduced, due to their bending configuration.

Thus, to counter the rigidification of the elastic strips due to their deformation in their recessed-guided configuration, a degree of freedom is added by way of linearising springs. The latter are thus named as, by enabling a movement of at least some of the two lateral coupling edges to the central crossmember of the frame during deformations of the elastic strips, they make it possible to reduce the constraints undergone by the elastic strips and consequently, to decrease, even avoid, their rigidification during their deformation. Such a rigidification would have the consequence of inducing a non-linear behaviour of the rigid plate during its movements. The linearising springs advantageously affecting the pressure level produced, by enabling an optimal flexibility over the whole stroke of the rigid plate, and thus reduce, even cancel, the geometric non-linearities which would in particular be linked to the abovementioned rigidification phenomenon if it were observed.

Another aspect relates to a method for manufacturing a micrometric speaker such as introduced above, comprising even being limited to, deposition and etching steps failing under microelectronics. The micrometric speaker 1 according to the first aspect of the invention can therefore advantageously be micromanufactured.

BRIEF DESCRIPTION OF THE FIGURES

The aims, objectives, as well as the characteristics and advantages of the invention will emerge better from the detailed description of an embodiment of the latter, which is illustrated by the following accompanying drawings, wherein.

Figure 1:
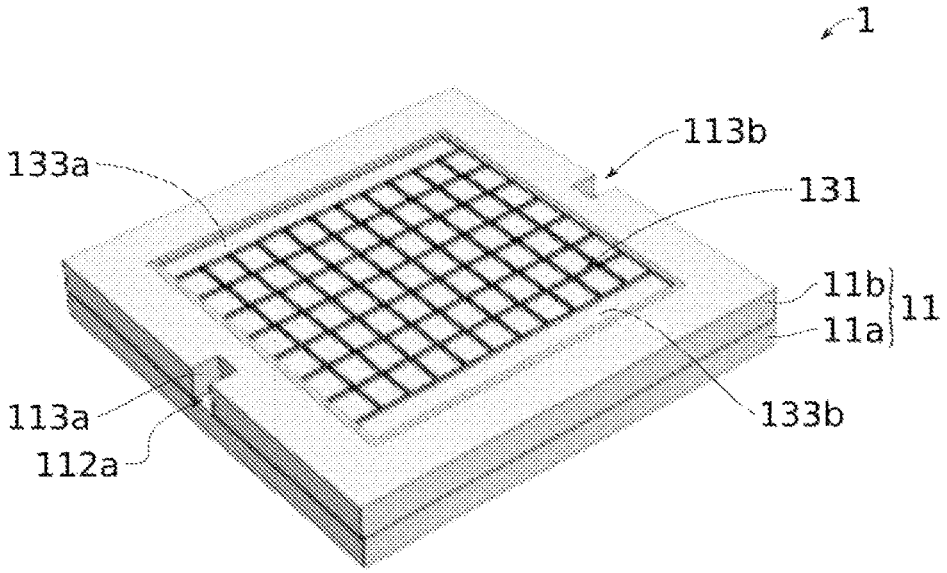
FIG. 1 represents a perspective view of an embodiment of the micrometric speaker according to the invention.

The drawings are given as examples and are not limiting of the invention. They constitute schematic principle representations intended to facilitate the understanding of the invention and are not necessarily to the scale of the practical applications. In particular, the thicknesses of the different layers or other elements extending mainly in two main extension directions are not necessarily representative of reality, in particular when these thicknesses are compared with the dimensions, in their main extension directions, of said layers or of said other elements, respectively.

DETAILED DESCRIPTION

Before starting a detailed review of embodiments of the invention, below optional characteristics of the micrometric speaker are stated according to the first aspect of the invention which can possibly be used in association or alternatively:

According to an example, each of the two piezoelectric actuators extends at most over half of the elastic strip which itself is associated from the lateral coupling edge of the mechanical-acoustic transducer which is engaged by said elastic strip. Optionally complementarily to this example, each of the two piezoelectric actuators extends at least over a quarter of the elastic strip which itself is associated from the lateral coupling edge of the mechanical-acoustic transducer which is engaged by said elastic strip.

According to another example, the micrometric speaker is preferably substantially symmetrical relative to a longitudinal cross-sectional plane of the central crossmember of the frame, which is perpendicular to the main extension plane of the frame.

According to another example, the micrometric speaker has no actuator, in particular no piezoelectric actuator, directly covering all or some of the rigid plate. According to another example, the piezoelectric actuators of the electromechanical transducer are moved relative to the rigid plate: in other words, the piezoelectric actuators of the electromechanical transducer are at a distance from the rigid plate. According to another example, the mechanical-acoustic transducer has no electromechanical transducer and/or the electromechanical transducer has no mechanical-acoustic transducer. More specifically, the rigid plate has no, or is not directly covered by, preferably even partially, an electromechanical transducer. Preferably, the rigid plate has no flexible membrane. According to another example, the electromechanical transducer and the mechanical-acoustic transducer are mechanically coupled to one another, preferably only by way of two lateral coupling edges of the mechanical-acoustic transducer. According to an example, the mechanical-acoustic transducer only comprises two lateral coupling edges. Preferably, the two lateral coupling edges extend from lateral edges of the rigid plate which are opposite one another and/or extend from the lateral edges of the rigid plate substantially perpendicularly to a plane wherein the rigid plate enters. According to an example, the other lateral edges of the rigid plate than those through which the rigid plate extends to form the two lateral coupling edges do not extend beyond the rigid plate. Preferably, each of the two lateral coupling edges is only linked to an edge of one of the two linearising springs and to an edge of one of the elastic strips. According to an example, the mechanical-acoustic transducer has no lateral edge, other than said two lateral coupling edges. According to an example, the mechanical-acoustic transducer has no lateral edge connecting the two lateral coupling edges of the mechanical-acoustic transducer together. Preferably, the rigid plate does not extend outside of the plane, wherein it only enters through the two lateral coupling edges of the mechanical-acoustic transducer. According to an example, the elastic strips are each uniform over their extent. According to an example, the mechanical-acoustic transducer does not extend beyond a zone delimited by the inner perimeter of outer edges of the frame. According to another example, the mechanical-acoustic transducer does not cover, nor intersect, the outer edges of the frame.

According to another example, each linearising spring has a stiffness at least ten times, preferably at least one hundred times, greater than a stiffness of the elastic strips. In this way, it is ensured to not alter the linear behaviour of the micrometric speaker, and this over the whole range of perceptible sound frequencies.

According to another example, the central crossmember of the frame extends at most over a first half of a thickness of the frame and the two elastic strips comprise one same layer secured to a face of the central crossmember which is oriented towards a centre of the frame. It is thus structurally easy to provide that the assembly formed from the electromechanical transducer and from the mechanical-acoustic transducer is moved within the frame, so as to be protected by it. Said layer is, for example, constituted of a silicon base. According to the preceding example, no elastic strip extends from a face of the central crossmember which is different from the face of the central crossmember oriented towards the centre of the frame.

According to another example, the rigid plate and the linearising springs comprise one same layer, a greater stiffness of the rigid plate relative to a stiffness of the linearising springs being due to structuring patterns that includes the rigid plate and which extend, from said layer, over a surface of the latter defining an extent of the rigid plate, the linearising springs themselves being constituted of portions of said layer which extend on either side of said surface. Said layer is, for example, constituted of a silicon base. Preferably, said portions which extend on either side of the surface from which the structuring patterns extend, themselves have no structuring patterns.

According to another example, the frame is configured such that the mechanical-acoustic transducer is located, from all sides, at a distance from the inner perimeter of the frame of between 1 and 100 μm, preferably between 2 and 80 μm, for example substantially equal to 9 μm. The gap between the frame and the mechanical-acoustic transducer is thus such that, at this gap, the propagation of the acoustic waves is mainly dominated by a thermoviscous behaviour. Thus, any acoustic short-circuiting phenomenon is avoided.

According to another example, the frame has, in its main extension plane, dimensions each of between 1 and 10 mm, preferably between 3 and 8 mm. An advantageous compromise is thus proposed between the maximum acoustic pressure level reachable by the micrometric speaker and the bulk of the latter.

According to another example, the lateral coupling edges of the mechanical-acoustic transducer extend from one of the two linearising springs over a distance greater than 750 μm, preferably greater than 500 μm. The thermoviscous losses due to the compression of air below the rigid plate are thus advantageously minimised.

According to another example, the elastic strips have a thickness of between 1 and 100 μm, preferably of between 5 and 20 μm. An advantageous compromise is thus proposed between choosing a low resonating frequency and choosing a high radiated pressure level.

According to another example, the two piezoelectric actuators are PZT-based, even constituted of PZT, and each extend over a face of one of the two elastic strips which is opposite the rigid plate of the mechanical-acoustic transducer.

According to another example, the elastic strips of the electromechanical transducer has a first resonating frequency and the linearising springs of the mechanical-acoustic transducer have a second resonating frequency, the second resonating frequency being at least one hundred times, preferably at least one thousand times, greater than the first resonating frequency. Thus, a wide bandwidth is conferred to the micrometric speaker.

According to another example, the frame comprises first and second parts, superposed and concentric to one another, a second part of the frame supports the central crossmember and comprises two terminals for electrically connecting to the piezoelectric actuators, the electrical connecting terminals preferably being located in the extension of the central crossmember and the second part of the frame comprising two notches configured to each be located opposite one of the two electrical connecting terminals. The reestablishment of contact of the piezoelectric actuators is thus such that it does not increase the bulk of the micrometric speaker.

By "micrometric", this means the quality of a device or element having a volume, or included in a casing, of less than 1 $cm^3$, preferably of less than 0.5 $cm^3$.

It is specified that, in the scope of the present invention, the term "rigid" qualifies a part or an element of the speaker which does not deform or hardly deforms under the effect of the constraints generally applied to it in normal operation. More specifically, it can be considered that the rigidity of the plate of the mechanical-acoustic transducer is ten times, even one hundred times, greater than the rigidity of the actuators.

It is specified that, in the scope of the present invention, the term "elastic" qualifies a part or an element of the speaker which is deformed under the effect of the constraints generally applied to it in normal operation. More specifically, it can be considered that the rigidity of the elastic strips is ten times, even one hundred times, less than the rigidity of the so-called rigid plate of the mechanical-acoustic transducer. For example, the terms "elastic strips" could be reformulated specifically by the terms "bending deformable strips".

By a material A-based film, a film comprising this material A and possibly other materials.

By a parameter "substantially equal to/greater than/less than" a given value than this parameter is equal to/greater than/less than the given value, at more or less 20%, even 10%, near this value. By a parameter "substantially of between" two given values, that this parameter is, as a minimum, equal to the smallest given value, at more or less 20%, even 10%, near this value, and as a maximum, equal to the greatest given value, at more or less 20%, even 10%, near this value.

According to its first aspect, a structural description of which is given below in reference to FIGS. 1 to 9, the invention relates to a micrometric speaker comprising:

A frame 11,

An electromechanical transducer 12, and

A mechanical-acoustic transducer 13.

The mechanical-acoustic transducer 13 comprises a rigid plate 131 movably mounted in the frame 11. In that, the micrometric speaker according to the first aspect of the invention is distinguished from flexible membrane micrometric speakers.

The electromechanical transducer 12 and the mechanical-acoustic transducer 13 are coupled to one another such that an urging of the electromechanical transducer 12 moves the mechanical-acoustic transducer 13 relative to the frame 11 and that a corresponding movement of the mechanical-acoustic transducer 13 is converted into acoustic pressure.

Figure 2:
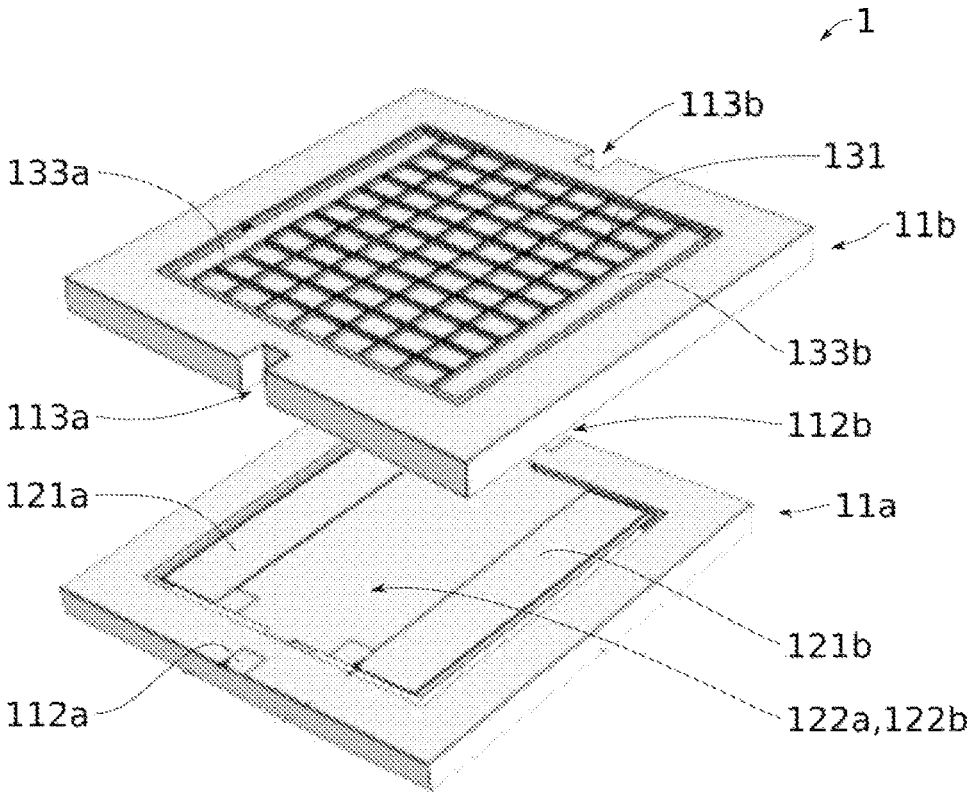
FIG. 2 represents an exploded view of the embodiment illustrated in FIG. 1.
Figure 3:
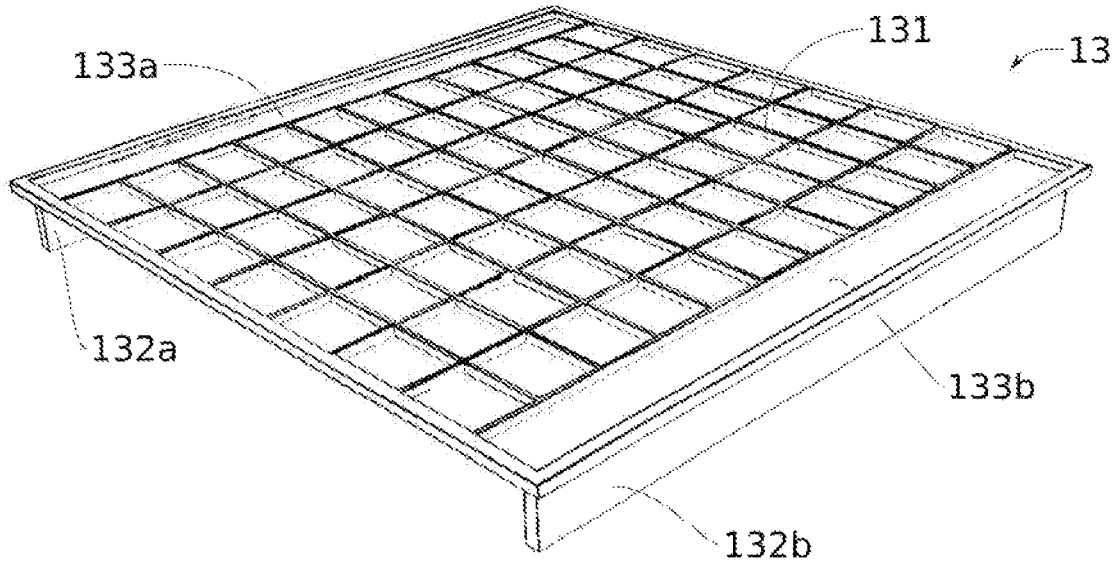
FIG. 3 represents a perspective view of the mechanical-acoustic transducer according to an embodiment of the micrometric speaker according to the invention.
Figure 4:
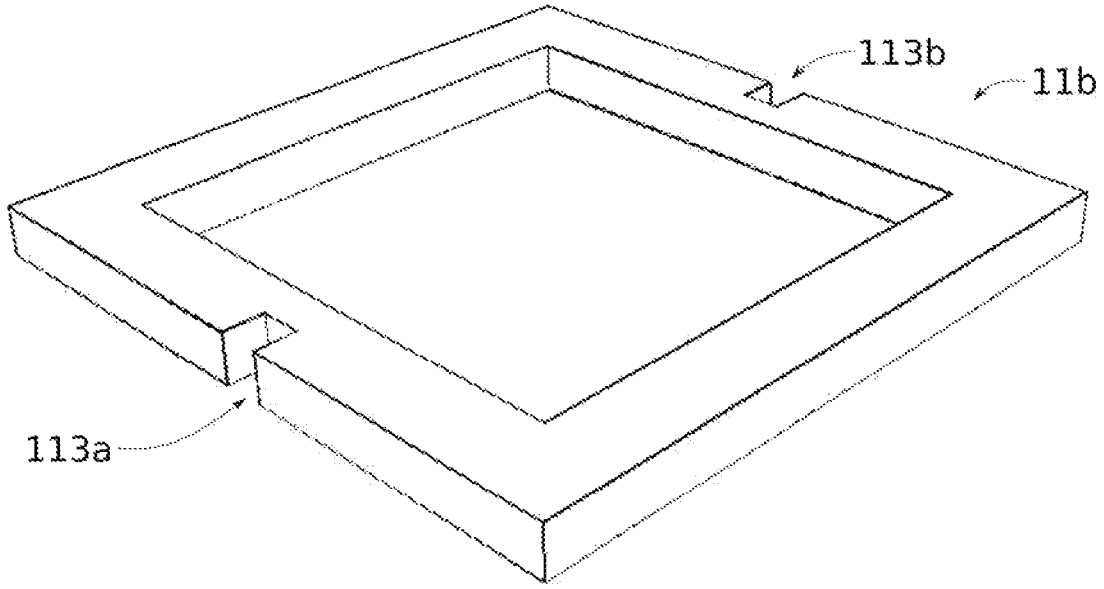
FIG. 4 represents a perspective view of some of the frame of an embodiment of the micrometric speaker according to the invention.

More specifically, and in particular in reference to FIG. 2, the electromechanical transducer 12 comprises two piezoelectric actuators 121*a*, 121*b* and two elastic strips 122*a*, 122*b*. Each piezoelectric actuator is associated with an elastic strip to induce, when it is electrically powered, a deformation of the elastic strip by bimetal effect. In other words, each piezoelectric actuator is associated with an elastic strip such that, when an electric voltage is applied to the piezoelectric actuator, the strip is deformed in bending.

Figure 5:
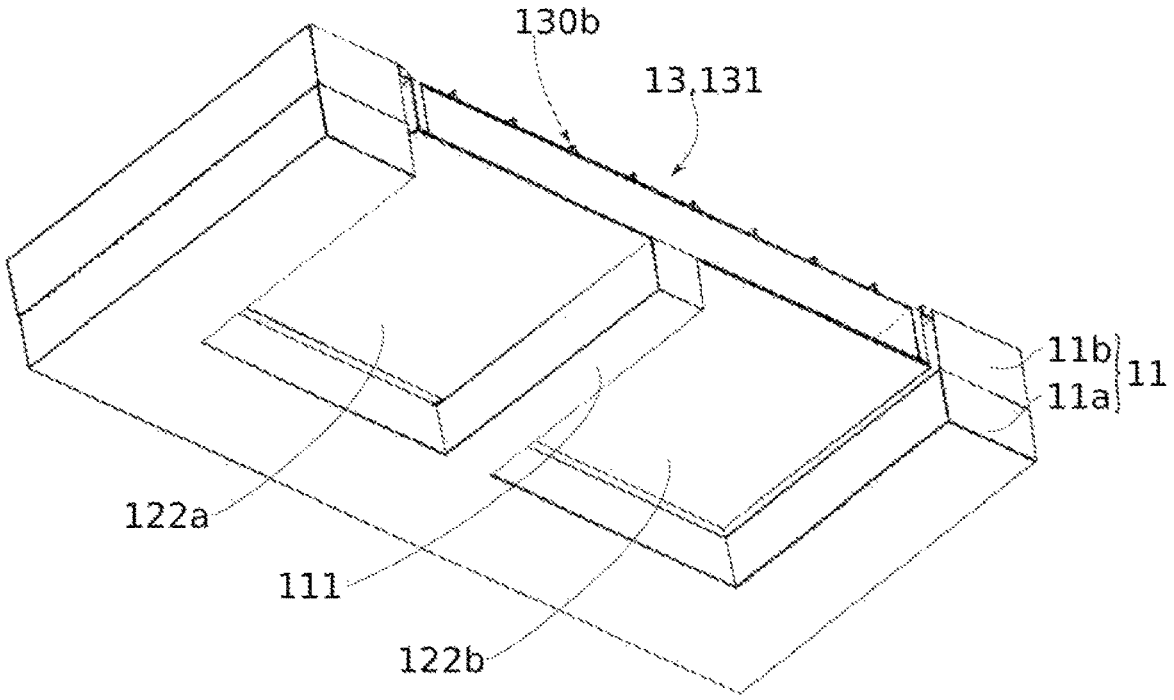
FIGS. 5 and 6 each represent a perspective vie of a cross-section of an embodiment of the micrometric speaker according to the invention, according to viewing angles which are different to one another.
Figure 6:
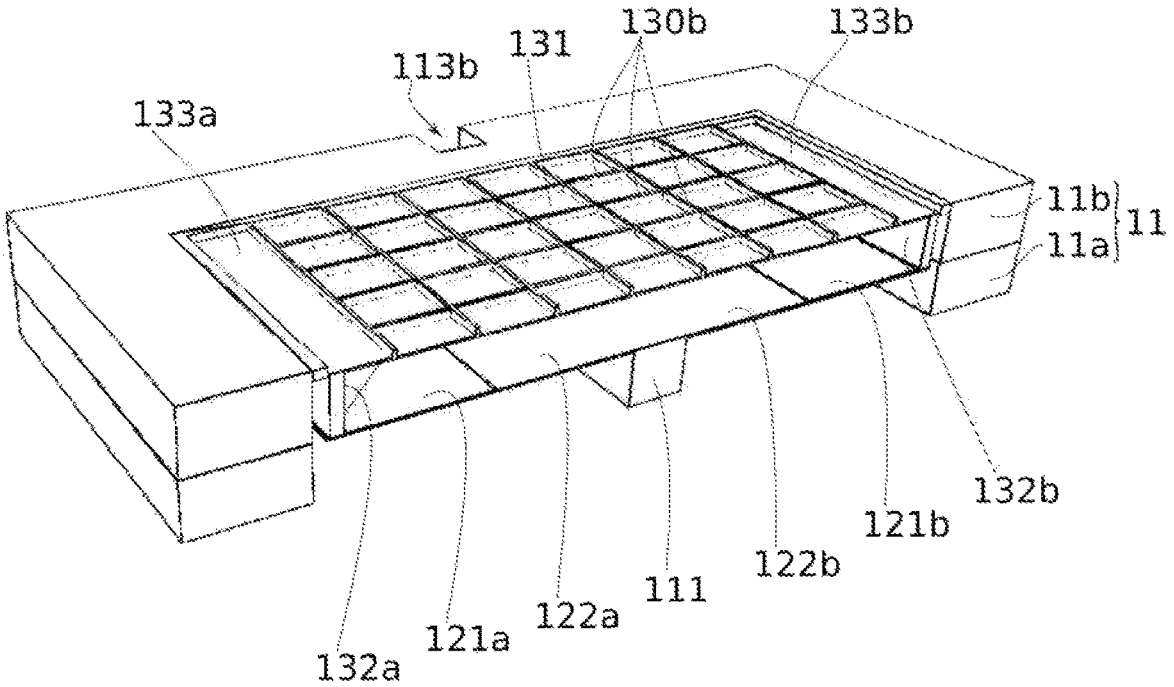

In reference to FIGS. 5 and 6, the frame 11 itself comprises a central crossmember 111 from which extend, securely to and opposite one another, the two elastic strips 122*a*, 122*b*. The two elastic strips 122*a*, 122*b* extend from the central crossmember 111 of the frame 11 until engaging two so-called lateral coupling edges 132*a*, 132*b* of the mechanical-acoustic transducer 13.

In this way, each elastic strip 122*a*, 122*b* is in a so-called "recessed-guided" bending configuration. In this configuration, when the piezoelectric actuators 121*a*, 121*b* are electrically powered, the elastic strips 122*a*, 122*b* are deformed by bending and drive with them, a movement of the rigid plate 131 of the mechanical-acoustic transducer 13 in a direction substantially perpendicular to a main extension plane of the frame 11. It thus appears that the mechanical-acoustic transducer 13 is more specifically movably mounted in the frame 11 by way of the electromechanical transducer 12.

The mechanical-acoustic transducer 13 further comprises at least two linearising springs 133*a*, 133*b*. The two linearising springs 133*a*, 133*b* each extend from one of the lateral coupling edges 132*a*, 132*b* of the mechanical-acoustic transducer 13 to a lateral edge of its rigid plate 131 which is located opposite. The linearising springs 133*a*, 133*b* are thus configured so as to enable, during a deformation of the elastic strips 122*a*, 122*b*, a movement of at least one part of the two lateral coupling edges 132*a*, 132*b* to the central crossmember 111 of the frame 11.

Figure 7:
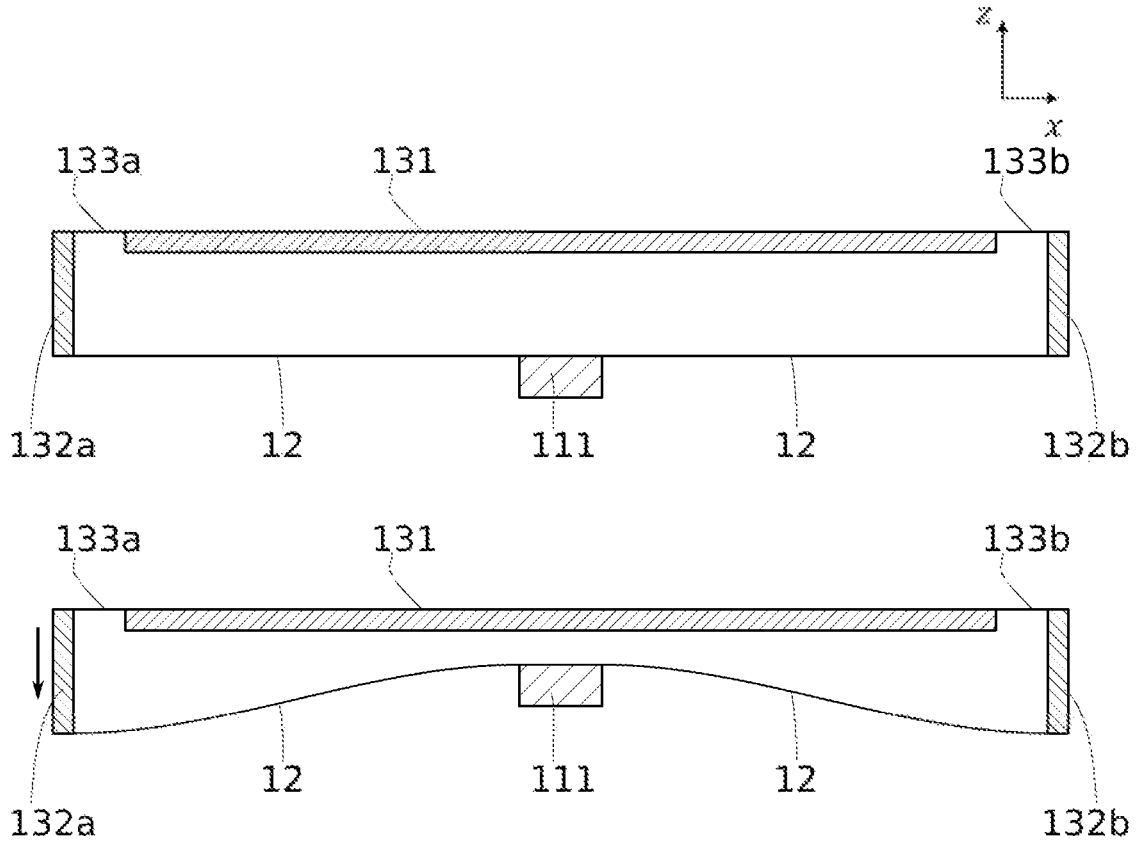
FIG. 7 is a schematic, cross-sectional representation of the assembly formed by the electromechanical transducer and the mechanical-acoustic transducer, in two positions which are different to one another, relative to the central crossmember of the frame according to an embodiment of the micrometric speaker according to the invention.
Figure 10:
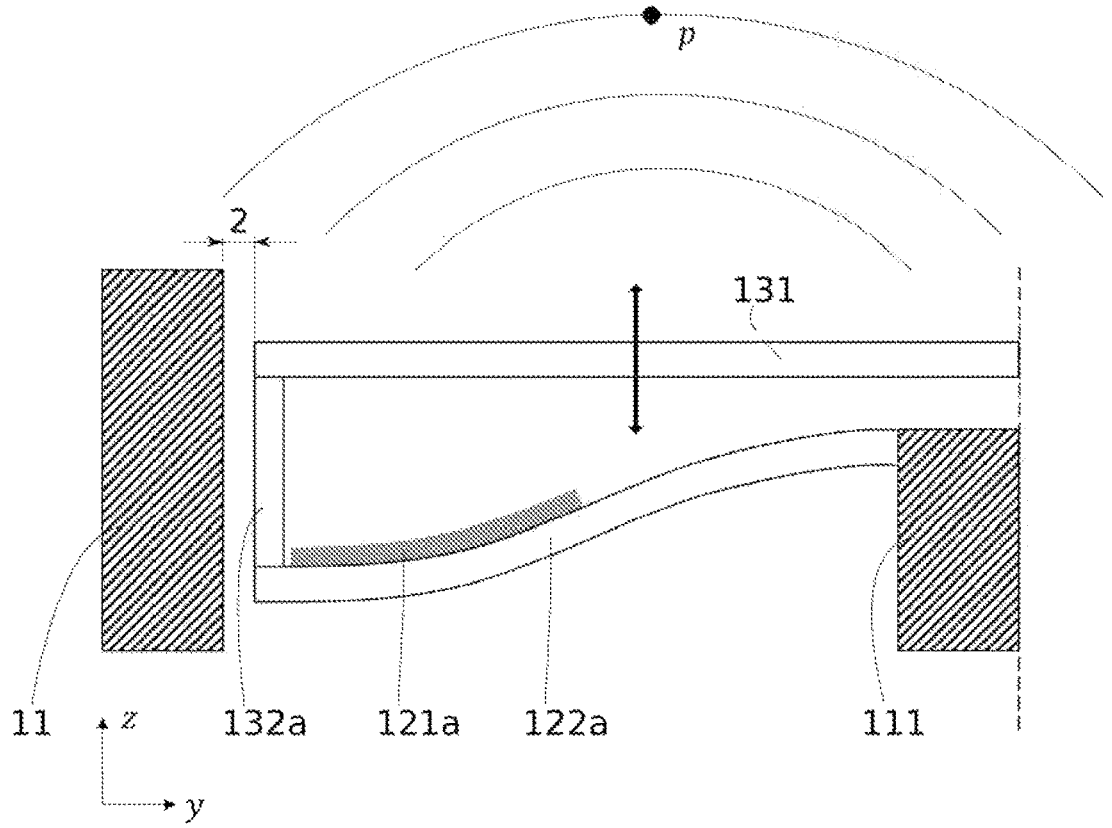
FIG. 10 is a schematic, half-cross-sectional view of an embodiment of the micrometric speaker according to the invention, generating acoustic waves.

When the piezoelectric actuators 121*a*, 121*b* are electrically powered, the elastic strips each adopt a deformation with a substantially central inflexion point and undergo longitudinal constraints, due to their recessed-guided bending configuration. The linearising springs 133*a*, 133*b* thus make it possible to absorb at least some of these longitudinal constraints. To this end, in particular when the piezoelectric actuators 121*a*. 121*b* are constituted of a PZT base, could only contract in the direction x such as illustrated in FIG. 7, the piezoelectric actuators 121*a*, 121*b* are preferably arranged only over half of the surface of the elastic strips 122*a*, 122*b*. More specifically, the piezoelectric actuators 121*a*, 121*b* each extend continuously from the edge of the elastic strip 122*a*, 122*b* to which it is associated, as is represented in FIG. 10, preferably over at least a quarter of the surface of said elastic strip, and preferably at most over half of this surface.

The linearising springs 133*a*, 133*b* add, to the micrometric speaker 1, a degree of freedom by enabling a movement of at least one of the two lateral coupling edges 132*a*, 132*b* of the mechanical-acoustic transducer 13 to the central crossmember 111 of the frame 11, during deformations of the elastic strips 122*a*, 122*b*. They thus make it possible to reduce the, in particular, longitudinal constraints undergone by the elastic strips 122*a*, 122*b*; yet such constraints could be at the origin of a rigidification of the elastic strips 122*a*, 122*b*, which would have the consequence of inducing a non-linear behaviour of the rigid plate 131 during its movements, or at least, for certain large amplitudes of its movements. As soon as the longitudinal constraints undergone by the elastic strips 122*a*, 122*b* are reduced, even made negligible. It is understood that the performances of the micrometric speaker 1 are enhanced.

As illustrated in FIGS. 6 and 6 in particular, the micrometric speaker 1 is preferably substantially symmetrical relative to a longitudinal cross-sectional plane of the central crossmember 111 of the frame 11, which is perpendicular to the main extension plane of the frame 11.

In reference to FIGS. 1 to 4, the micrometric speaker 1 according to the embodiment illustrated can also be considered as comprising two parts superposed on one another concentrically. In particular, the frame 11 can be seen as constituted of two parts 11*a* and 11*b*, a first part 11*a* of which supports, preferably only by itself, the central crossmember 111 of the frame 11 and a second part 11*b* configured to be housed there closely in the mechanical-acoustic transducer 13. It will be seen, when an example of a manufacturing method is described below, by microelectronic means, of the micrometric speaker 1 such as illustrated in FIGS. 1 to 9, that this two-part view of said micrometric speaker 1 is connected to the fact that two silicon wafers are, according to said method, treated individually before being assembled to form the compact micrometric speaker 1 such as illustrated in FIG. 1. In particular, it will appear that each of the parts 11*a* and 11*b* of the frame 11 comes from one of the two silicon wafers.

FIG. 7 shows a cross-sectional view of the operating speaker. It shows, more specifically, two views superposed on one another of the electromechanical transducer 12 and of the mechanical-acoustic transducer 13, on the one hand, in a non-deformation configuration of the elastic strips 122*a*,

122*b* (where the piezoelectric actuators are not electrically powered), on the other hand in a deformation configuration of the elastic strips 122*a*, 122*b* (where the piezoelectric actuators are electrically powered), relative to the central crossmember 111 of the frame 11, the latter remaining fixed due to the fixing of the frame 11 itself, for example on a support (not represented). Thus, when an electric voltage is applied between the top and the bottom of the piezoelectric material layers constituting the piezoelectric actuators 121*a*, 121*b*, these contract in the direction x. Under the effect of the contraction, and due to each of the two bimetals that constitute the association of an elastic strip with a piezoelectric actuator being secured to the rigid plate 131, the elastic strips 122*a*, 122*b* adopt a deformation with an inflexion point and their ends move in the direction z and more specifically in the direction −z, driving the entity formed from the electromechanical transducer 12 and the mechanical-acoustic transducer 13 in the same direction and in the same way. When the piezoelectric actuators 121*a*, 121*b* are then no longer electrically powered, the elasticity of the elastic strips 122*a*, 122*b* makes it possible to return the entity formed from the electromechanical transducer 12 and the mechanical-acoustic transducer 13 in its starting position. In this so-called starting position, or equally the non-powered position of the piezoelectric actuators 121*a*, 121*b*, the rigid plate 131 can become flush with the perimeter of the face of the frame 11 which is oriented upwards in the figures.

When the micrometric speaker 1 only enables movements of the rigid plate 131 in the direction −z by electrically powering piezoelectric actuators 121*a*, 121*b*, in particular due to these being PZT-base constituted, it is necessary to add a direct voltage to the terminals of each piezoelectric actuator 121*a*, 121*b* to obtain a rest point in the middle of the dynamics of the speaker 1, to obtain an alternative movement around this operating point. For example, the piezoelectric actuators operate with a range of electrical power voltage substantially of between 0 and 30V, and the direct voltage added to the terminals of each piezoelectric actuator 121*a*, 121*b* is substantially equal to 15V.

Figure 8:
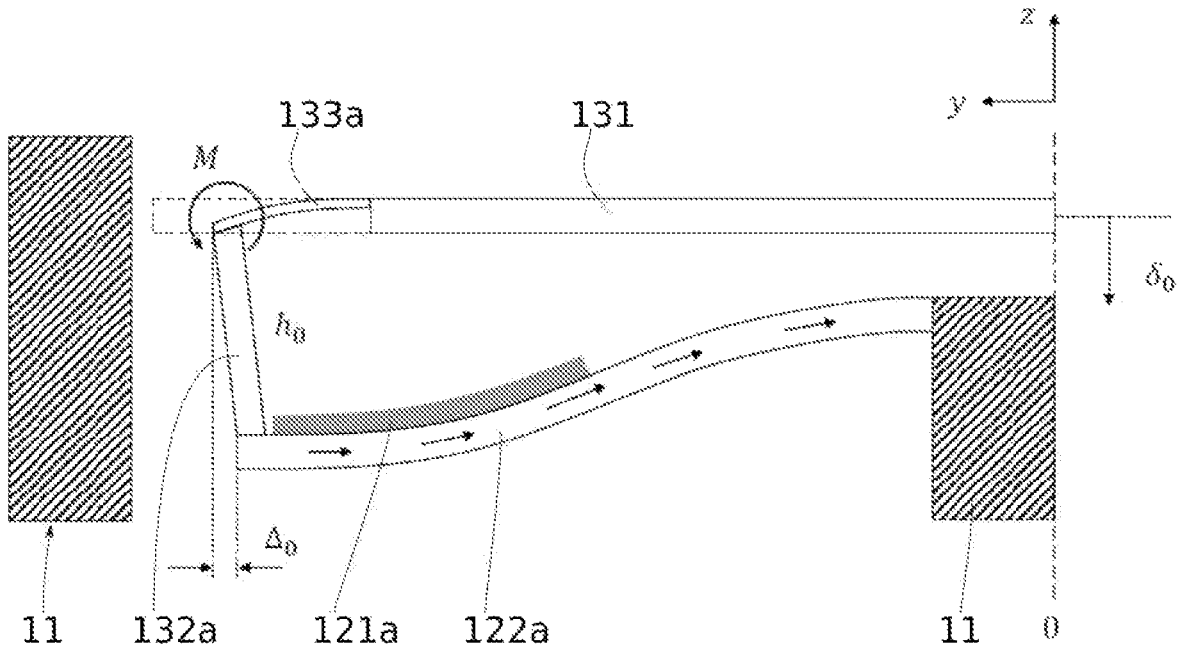
FIG. 8 is an operating diagram as a half-cross-section of an embodiment of the micrometric speaker according to the invention, when the electromechanical transducer is electrically powered.

FIG. 8 schematically shows the operating principle of the micrometric speaker 1 according to the first aspect of the invention comprising an additional degree of freedom which itself is conferred by the linearising springs 133*a*, 133*b*. As illustrated in this figure, when an electrical voltage is applied to the terminals of the piezoelectric actuators 121*a*. 121*b*, the elastic strips 122*a*, 122*b* are deformed and move the rigid plate 131 by a distance $\delta_0$ along −z. For an ideal linear operation, the length of the curve of each deformed elastic strip 122*a*, 122*b* must be identical to the length of the non-deformed elastic strip 122*a*, 122*b*. In FIG. 8, the difference between the position of the distal end of the elastic strip 122*a*, before and after deformation, and in the direction y, is referenced $\Delta_0$. This difference is enabled by the linearising spring 133*a* secured to the rigid plate 131 by its end opposite that by which the linearising spring 133*a* is secured to the distal end of the elastic strip 122*a*. The idea is that the movement $\Delta_0$ deforms the linearising spring 133*a* by using the height $h_0$ of the lateral coupling edge 132*a* of the mechanical-acoustic transducer 13 like a lever arm.

To significantly reduce the geometric non-linearities, it is preferable that the stiffness of each linearising spring, actuated via the lateral coupling edge, of height $h_0$, which itself is associated with a serving as a lever, is 10 times, preferably 100 times, less than the apparent stiffness of the actuators along the axis outside of the main extension plane of the frame.

Figure 9:
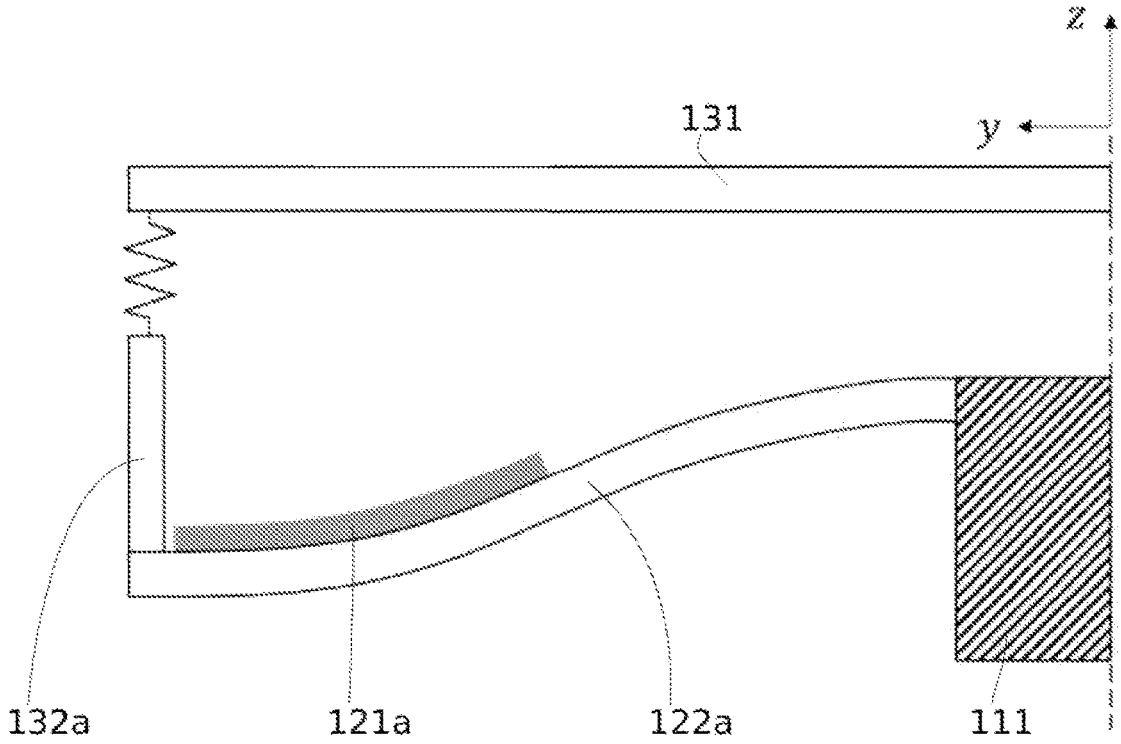
FIG. 9 is a diagram of a system equivalent to that represented in FIG. 8.

In particular, if the stiffness of the linearising spring 133*a* is greater than the stiffness of the elastic strip 122*a*, the micrometric speaker 1 such as described above enables a guiding of the mechanical-acoustic transducer 13 similar to that would enable the equivalent system represented in FIG. 9. The diagram of this figure shows a piezoelectric actuator 121*a* and the elastic strip 122*a* which itself is associated in a deformed state, the elastic strip 122*a* being connected to the rigid plate 131 by a spring representing the stiffness of the linearising spring 133*a* along the axis z. Considering the piezoelectric actuator 121*a* and the elastic strip 122*a* as a mechanical actuator, and knowing that, according to the principle diagram of FIG. 9, the characteristic of the mechanical actuator thus defined is the line connecting its blocked force (force generated by the actuator when the translation of its end is blocked along z) and its free movement (maximum movement of the end of the actuator without charge at its end), the stiffness of the spring illustrated in FIG. 9 cuts the characteristic of the mechanical actuator at its operating point. For a spring such as illustrated in FIG. 9 which is quite stiff, the force corresponding to the operating point hardly differs from the blocked force of the mechanical actuator, which advantageously enables to confer to the mechanical actuator, a linear behaviour over its operating range.

The principle diagram illustrated in FIG. 9 therefore makes it possible to illustrate why it is preferred that each linearising spring 133*a*, 133*b* has a stiffness at least ten to times, preferably at least one hundred times, greater than a stiffness of the elastic strips 122*a*, 122*b*. The additional degree of freedom conferred by the linearising springs makes it possible to reduce the non-linearities. The fact that the linearising springs are more rigid than the actuators makes it possible to not alter the response in frequency of the micrometric speaker.

Another characteristic conveying this same preference differently, consists of specifying that the elastic strips of the electromechanical transducer 12 has a first resonating frequency and the linearising springs 133*a*, 133*b* of the mechanical-acoustic transducer 13 have a second resonating frequency, the second resonating frequency being at least one hundred times, preferably at least one thousand times, greater than the first resonating frequency. It is thus ensured that the second resonating frequency is outside of the desired bandwidth reached by the micrometric speaker 1, and it is thus conferred, to the micrometric speaker 1, a wide bandwidth for an optimised range of perceptible sound frequencies.

By powering the piezoelectric actuators 121*a*, 121*b* with an alternating voltage, around a direct positive voltage, the rigid plate 131 moves from top to bottom, and generates acoustic waves, as illustrated in FIG. 10.

Figure 11:
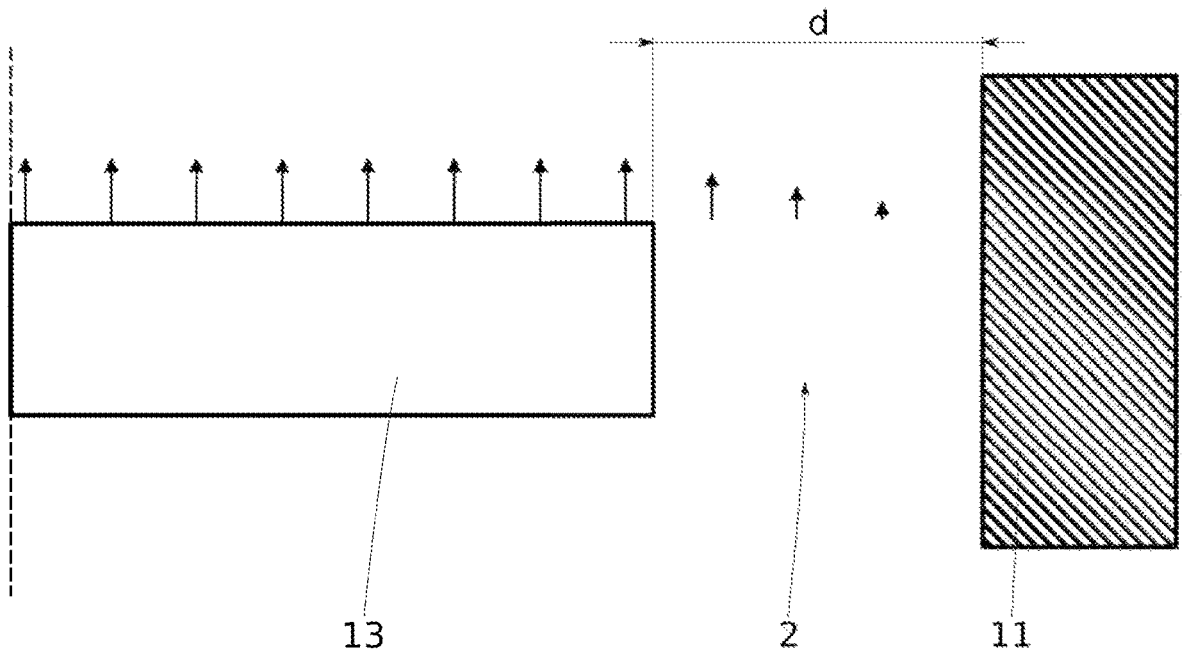
FIG. 11 is a schematic, half-cross-sectional view of the gap between the outer edges of the mechanical-acoustic transducer and the inner perimeter of the frame according to an embodiment of the micrometric speaker according to the invention.

In conventional speakers, the acoustic short-circuit, resulting from the interference between the positive (or negative) waves created by the front of the vibrating rigid plate, and the negative (or positive) waves created by the rear of this same plate, can be prevented by a deformable suspension. For the micrometric speaker 1, according to the first aspect of the invention, the acoustic short-circuit is prevented by using a dimension d of a gap 2 between the frame 11 and the rigid plate 131, and more specifically between the inner perimeter of the frame 11 and the lateral coupling edges 132*a*, 132*b* of the mechanical-acoustic transducer 13, such that the thermoviscous behaviour dominates in 3*s* this gap 2. FIG. 11 shows a schematic representation of a part of the mechanical-acoustic transducer 13, of the frame 11 and of the gap 2 in question, on which the dimension d of the gap 2 is represented.

More specifically, the frame 11 is configured such that the mechanical-acoustic transducer 13 is located, from all sides, at an interstitial distance from the inner perimeter of the frame 11 of between 1 and 100 μm, preferably between 2 and 80 μm. A finished element simulation can make it possible to determine, for each sizing of the micrometric speaker 1 according to the first aspect of the invention, the interstitial distance making it possible to optimise the thermoviscous behaviour of the air in the gap 2. For the specific dimensions given below, purely as an example, this finished element simulation shows that the optimal dimension of the gap 2 is substantially equal to 9 μm. The gap 2 between the frame 11 and the mechanical-acoustic transducer 13 is thus such that, at this gap 2, the propagation of acoustic waves is mainly dominated by a thermoviscous behaviour. Any acoustic short-circuiting phenomenon is thus avoided.

Figure 12:
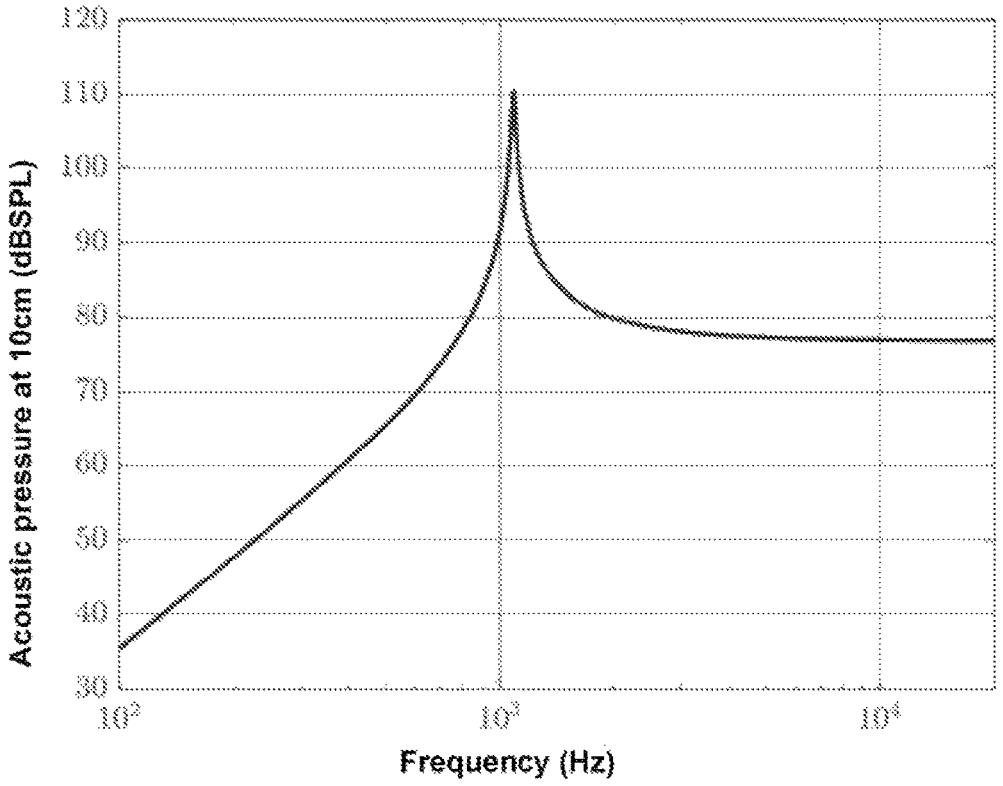
FIG. 12 is a graph showing the response in acoustic pressure level of a micrometric speaker according to an embodiment of the invention over a range of excitation frequencies of said speaker.

The dimensions of the micrometric speaker 1 are important, of course, as they impact on the dimensions of the rigid plate 131 and on the dimensions of the elastic strips 122*a*, 122*b*, and consequently, on those of the piezoelectric actuators 121*a*, 121*b*. A larger speaker will have a larger, heavier rigid plate 131, of the more flexible elastic strips 122*a*, 122*b* and will generate more force. Therefore, it will have a lower resonating frequency, and therefore a wider bandwidth in low frequencies. FIG. 12 shows the response in frequency of a micrometric speaker 1 according to the first aspect of the invention, the rigid plate 131 of which has dimensions of 8×8 $mm^2$. It is only observed there that the resonating frequency of such a micrometric speaker 1 is substantially equal to 1 kHz. Smaller dimensions will give a higher resonating frequency, and therefore a wider bandwidth. Nevertheless, dimensions going from 1×1 $mm^2$ to 10×10 $mm^2$ of the micrometric speaker 1 according to the first aspect of the invention are considered. The dimensions going from 3×3 $mm^2$ to 8×8 $mm^2$ will, for example, be favoured for reasons of compromise between performance and bulk.

The height $h_0$ of the lateral coupling edges 132*a*, 132*b* represented in FIG. 8 is optimised such that the thermoviscous losses due to compressed air below the rigid plate 131 are minimised. For a height $h_0$ greater than 500 μm, the thermoviscous losses do not significantly modify the response in frequency of the micrometric speaker 1. This height however depends on other dimensions of the micrometric speaker 1. That is why, more generally, the lateral coupling edges 132*a*, 132*b* of the mechanical-acoustic transducer 13 extend from one of the two linearising springs 133*a*, 133*b* over a distance greater than 750 μm, preferably greater than 500 μm.

The response in frequency of the micrometric speaker 1 can also be greatly affected by the thickness of the elastic strips 122*a*, 122*b* supporting the piezoelectric actuators 121*a*, 121*b*. Thinner elastic strips 122*a*, 122*b* will give a lower resonating frequency and thicker elastic strips 122*a*, 122*b* will give more force to the micrometric speaker 1, and therefore a higher radiated pressure level. A compromise is therefore preferably to be determined to have a low resonating frequency and a satisfactory pressure level. This dimension depends again on the other dimensions of the micrometric speaker 1. Typically, the elastic strips 122*a*, 122*b* can have a thickness of between 1 and 100 μm, preferably of between 5 and 20 μm, and for example, substantially equal to 12 μm.

FIGS. 13 to 16 give an example of a method for manufacturing a micrometric speaker 1 according to an embodiment of the first aspect of the invention. This method advantageously implements technological steps, in particular depositing and etching steps, which are ordinary in microelectronics. These technological steps are, for example, performed from two silicon wafers. More specifically, as already introduced above and is according to the example illustrated, two silicon wafers can be individually treated, assembled together, then the assembly can itself be treated to obtain the micrometric speaker 1 according to an embodiment of the first aspect of the invention. However, any other conventional mechanical assembly method, than that illustrated in the figures, can be used.

Figure 13:
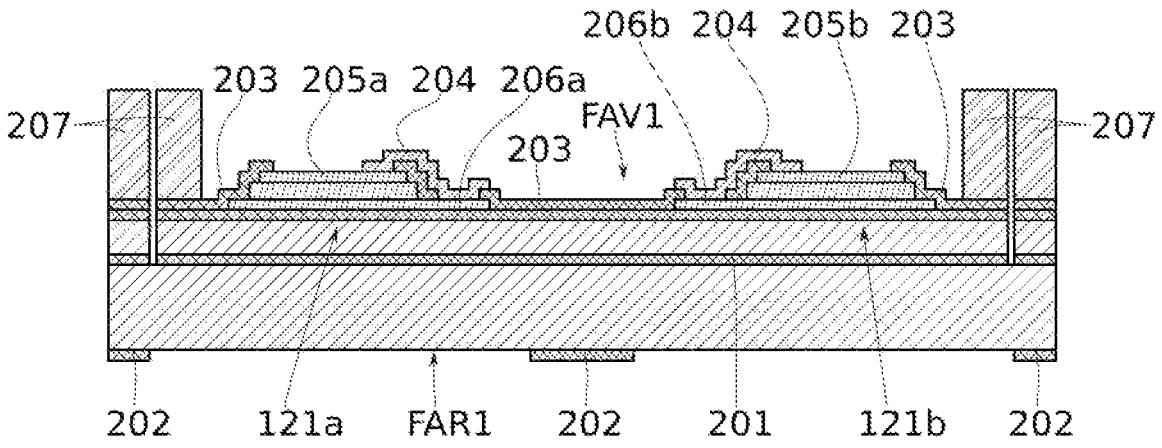
FIGS. 13 to 16 each illustrate a cross-sectional view of a step of the method for manufacturing a micrometric speaker according to an embodiment of the invention.

According to the example illustrated, the manufacturing starts with a BESOI wafer, composed of two silicon layers separated by a silicon oxide layer 201. On the thinner layer, located on the front face FAV1 of the BESOI wafer and intended to constitute the elastic strips 122*a*, 122*b*, a stack comprising a first electrode layer, a layer of a piezoelectric material, then a second electrode layer, is deposited. As illustrated in FIG. 13, a hard mask 202 is etched on the rear face FAR1 in view of subsequently performing a step of deep etching through this rear face. The piezoelectric transducers 121*a*, 121*b* are then etched and protected by a passivation 203. Electrical contacts 204 enabling the electrical powering of the upper 205*a*, 206*a* and lower 205*b*, 206*b* electrodes of the piezoelectric actuators 121*a*, 121*b* and a material 207 intended to enable the gluing of the treated BESOI wafer to the second treated wafer are then deposited by the front face FAV1 of the BESOI wafer.

Figure 14:
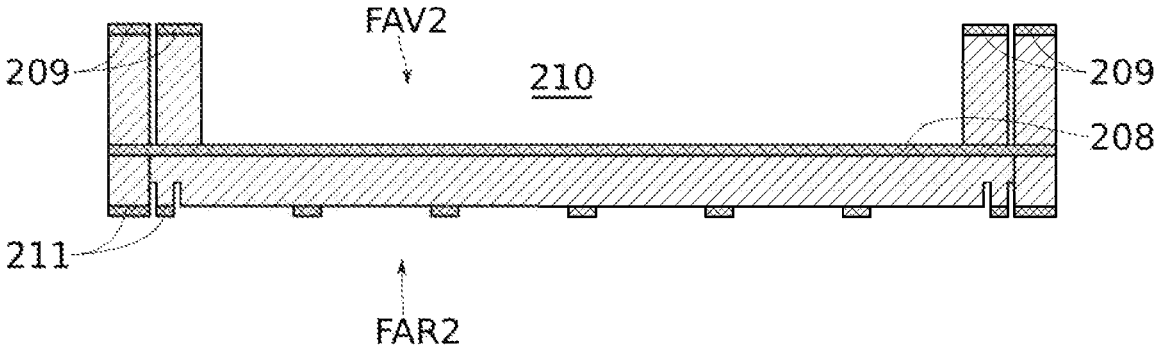

In reference to FIG. 14, the second wafer, composed of two silicon layers separated by an oxide layer 208 is intended to constitute a second part of the speaker 1, and in particular the rigid plate 131 and the second part 11*b* of the frame 11. A hard mask 209 is etched on the front face FAR2 to enable the deep etching of a rear cavity 210. A hard mask 211 is etched on the rear face FAR2 to enable the subsequent etching of structuring patterns 130*b*, taking, for example, the form of bars for reinforcing the rigid plate 131.

Figure 15:
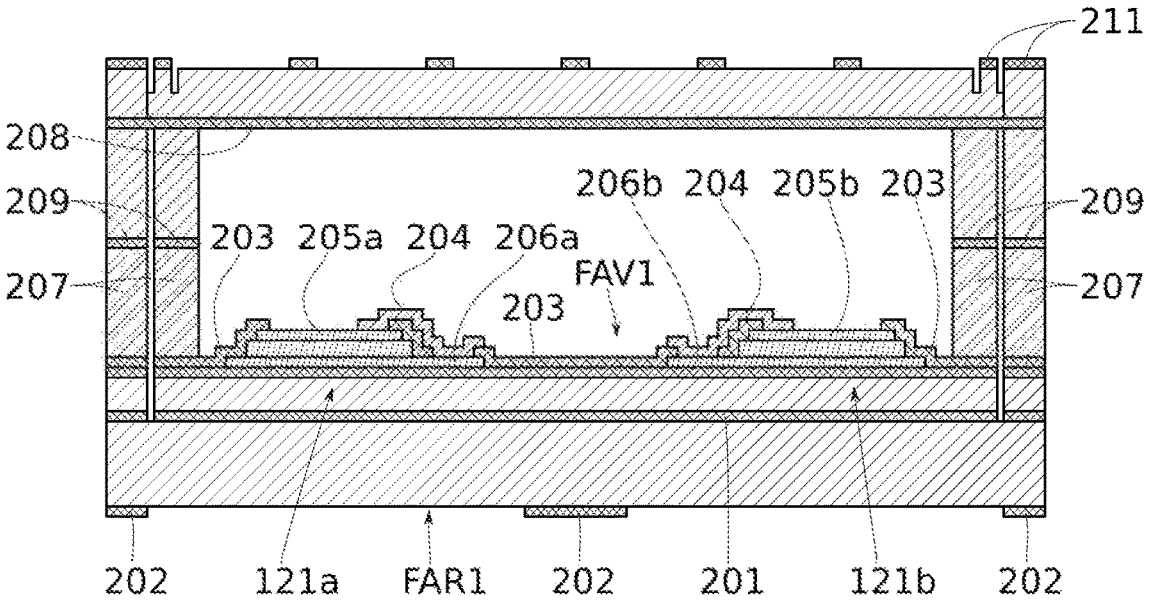
Figure 16:
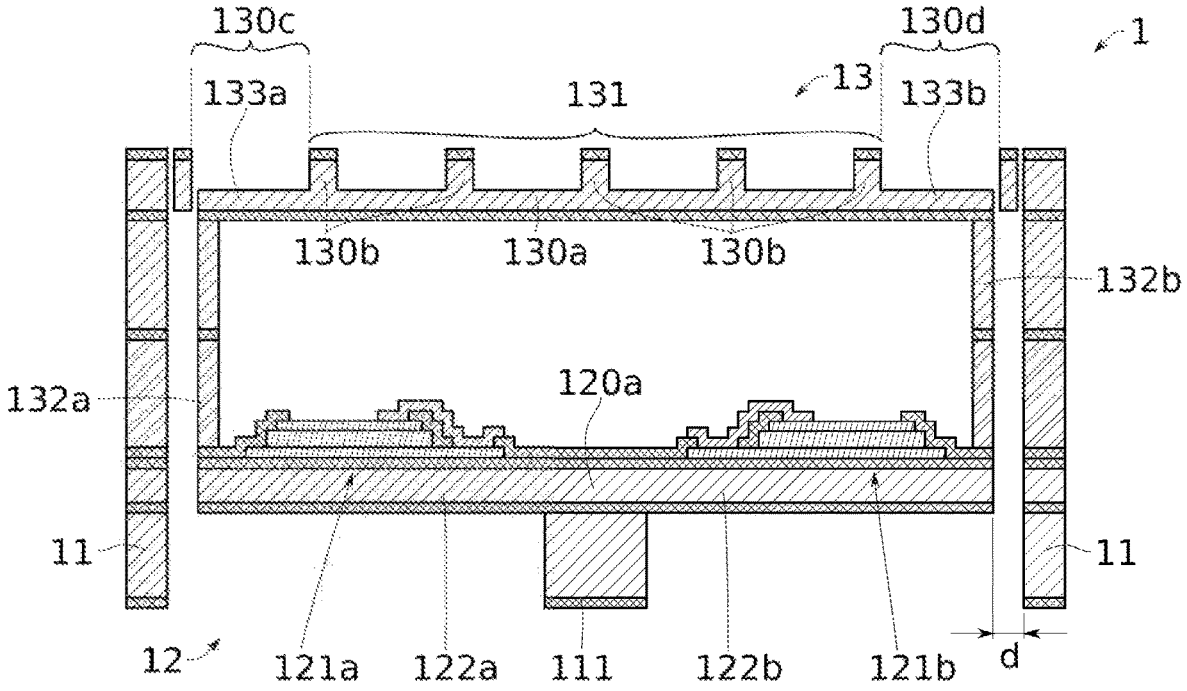

Once the two wafers are thus treated, they are assembled to one another by their respective front faces FAV1 and FAV2, in the way illustrated in FIG. 15. The structuring patterns 130*b* of the rigid plate 131, as well as the gap d between the rigid plate 131 and the frame 11 are then etched by the rear face FAR2 of the second silicon wafer. The rear face FAR1 of the BESOI wafer is then etched to reach the speaker 1 such as illustrated in FIG. 16.

It is thus noted that the two elastic strips 122*a*, 122*b* comprise one same layer 120*a* secured to a face of the central crossmember 111 which is oriented towards a centre of the frame 11. Said layer 120*a* is constituted of a silicon base.

Likewise, it is noted that the rigid plate 131 and the linearising springs 133*a*, 133*b* comprise one same layer 130*a*. A greater stiffness of the rigid plate 131 relative to a is stiffness of the linearising springs 133*a*, 133*b* is due to the structuring patterns 130*b* that the rigid plate (131) includes. More specifically, these structuring patterns 130*b* extend from said layer 130*a*, over a surface of the latter defining the extent of the rigid plate 131. The linearising springs 133*a*, 133*b* are themselves constituted of portions 130*c*, 130*d* of said layer 130*a* which extend on either side of said surface. Moreover, it appears that said layer 130*a* is constituted of a silicon base.

The invention is not limited to the embodiments described above and extends to all the embodiments covered by the claims.

In particular, the frame 11 comprises a perimeter, preferably closed. Preferably, but in a non-limiting manner, the crossmember 111 of the frame 11 is secured to the inner perimeter of the frame 11 by its two ends.

Although the frame 11 is represented as having a parallelepiped geometry, other shapes of the frame 11 can be considered, whether for its inner perimeter or its outer perimeter. Thus, a frame 11 of angular or oblong shape can be considered. If necessary, the micrometric speaker 1 will comprise more than two piezoelectric actuators each associated from among a corresponding plurality of elastic strips.

The invention claimed is:

1. A micrometric speaker, comprising:

a frame, an electromechanical transducer, and a mechanical-acoustic transducer comprising a rigid plate, movably mounted in the frame, the electromechanical transducer and the mechanical-acoustic transducer being coupled to one another such that an urging of the electromechanical transducer moves the mechanical-acoustic transducer relative to the frame and is converted into acoustic pressure, the electromechanical transducer comprises at least two piezoelectric actuators and at least two elastic strips, each piezoelectric actuator being associated with an elastic strip to induce, when electrically powered, a deformation of the elastic strip by a bimetal effect, the frame comprises a central crossmember from which extend, securely and opposite one another, the two elastic strips, the two elastic strips extend from the central crossmember of the frame until engaging two lateral coupling edges of the mechanical-acoustic transducer, so that each elastic strip is in a recessed-guided bending configuration, according to which, when the piezoelectric actuators are electrically powered, the elastic strips are deformed and drive a movement of the rigid plate of the mechanical-acoustic transducer in a direction substantially perpendicular to a main extension plane of the frame, and wherein the mechanical-acoustic transducer further comprises at least two linearizing springs each extending from one of the lateral coupling edges to a lateral edge of the rigid plate which is located opposite, the linearizing springs being configured so as to enable, during a deformation of the elastic strips, a movement of at least one of the two lateral coupling edges to the central crossmember of the frame.

2. The micrometric speaker according to claim 1, wherein each of the two piezoelectric actuators extends at most over half of the elastic strip, which is associated from the lateral coupling edge of the mechanical-acoustic transducer which is engaged by said elastic strip.

3. The micrometric speaker according to claim 1, wherein each linearizing spring has a stiffness at least ten times greater than a stiffness of the elastic strips.

4. The micrometric speaker of claim 3, wherein each linearizing spring has the stiffness at least one hundred times greater than the stiffness of the elastic strips.

5. The micrometric speaker according to claim 1, wherein the central crossmember of the frame extends at most over a first half of a thickness of the frame and the two elastic strips comprise one same layer secured to a face of the central crossmember which is oriented towards a center of the frame.

6. The micrometric speaker according to claim 5, wherein said layer is constituted of a silicon base.

7. The micrometric speaker according to claim 1, wherein the rigid plate and the linearizing springs comprise one same layer, a greater stiffness of the rigid plate relative to a stiffness of the linearizing springs being due to structuring patterns that the rigid plate includes and which extend, from said layer, over a surface of the latter defining an extent of the rigid plate, the linearizing springs being constituted of portions of said layer which extend on either side of said surface.

8. The micrometric speaker according to claim 7, wherein said layer is constituted of a silicon base.

9. The micrometric speaker according to claim 1, wherein the frame is configured such that the mechanical-acoustic transducer is located, from all sides, at a distance from the inner perimeter of the frame of between 1 and 100 μm.

10. The micrometric speaker of claim 9, wherein the flame is configured such that the mechanical-acoustic transducer is located, from all sides, at the distance from the inner perimeter frame of between 2 and 80 μm.

11. The micrometric speaker according to claim 1, wherein the frame has, in a main extension plane, dimensions each being between 1 and 10 mm.

12. The micrometric speaker of claim 11, wherein the frame has dimensions each being between 3 and 8 mm.

13. The micrometric speaker according to claim 1, wherein the lateral coupling edges of the mechanical-acoustic transducer extend from one of the two linearizing springs over a distance greater than 750 μm.

14. The micrometric speaker according to claim 1, wherein the elastic strips have a thickness of between 1 and 100 μm.

15. The micrometric speaker of claim 14, wherein the elastic strips have the thickness of between 5 and 20 μm.

16. The micrometric speaker according to claim 1, wherein the piezoelectric actuators are PZT-based and each extend over a face of one of the two elastic strips that is opposite the rigid plate of the mechanical-acoustic transducer.

17. The micrometric speaker according to claim 1, wherein the elastic strips of the electromechanical transducer have a first resonating frequency and the linearizing springs of the mechanical-acoustic transducer have a second resonating frequency, the second resonating frequency being at least one hundred times greater than the first resonating frequency.

18. The micrometric speaker of claim 17, wherein the second resonating frequency of the linearizing springs is at least one thousand times greater than the first resonating frequency.

19. The micrometric speaker according to claim 1, wherein the frame comprises first and second parts superposed and concentric to one another, a second part of the frame supports the central crossmember and comprises two terminals for electrically connecting to the piezoelectric actuators, the electrical connecting terminals being located in the extension of the central crossmember, and the second part of the frame comprises two notches configured to each be located opposite one of the two electrical connecting terminals.

20. A method for manufacturing the micrometric speaker according to claim 1, comprising depositing and etching steps using microelectronics.

* * * * *